US008464724B2

(12) United States Patent
Balletti et al.

(10) Patent No.: US 8,464,724 B2
(45) Date of Patent: Jun. 18, 2013

(54) MANUFACTURING MACHINE FOR PRODUCING TOBACCO INDUSTRY ARTICLES

(75) Inventors: Leonardo Balletti, San Lazzaro di Savena (IT); Marco Esposti, Casalecchio di Reno (IT)

(73) Assignee: G.D Societa' per Azioni, Bologna (IT)

( * ) Notice: Subject to any disclaimer, the term of this patent is extended or adjusted under 35 U.S.C. 154(b) by 629 days.

(21) Appl. No.: 12/504,934

(22) Filed: Jul. 17, 2009

(65) Prior Publication Data

US 2010/0012135 A1 Jan. 21, 2010

(30) Foreign Application Priority Data

Jul. 18, 2008 (IT) ..... BO2008A0454

(51) Int. Cl.
*A24C 1/32* (2006.01)

(52) U.S. Cl.
USPC ..... 131/88

(58) Field of Classification Search
None
See application file for complete search history.

(56) References Cited

FOREIGN PATENT DOCUMENTS

| | | | |
|---|---|---|---|
| EP | 1 532 879 | A1 | 5/2005 |
| EP | 1 913 825 | A1 | 4/2008 |
| WO | WO 03/024256 | A2 | 3/2003 |
| WO | WO 2005/048747 | A1 | 6/2005 |

OTHER PUBLICATIONS

Hauni Richamond Inc., "Hauni Lab-Max: Highly Flexible Tipping Machine for Sample Filter Cigarettes", 2006, Hauni and British American Tobacco, accessed via http://legacy.library.ucsf.edu/tid/tfg17a99 on Apr. 10, 2012.*

* cited by examiner

*Primary Examiner* — Michael J Felton
(74) *Attorney, Agent, or Firm* — Oblon, Spivak, McClelland, Maier & Neustadt, L.L.P.

(57) ABSTRACT

A manufacturing machine for producing tobacco industry articles, and having at least one station having a number of drums cooperating with one another to convey and process filter portions; and a supporting structure fitted to a frame and supporting the drums at the station. The station has a vertical front panel supporting at least some of the drums at the station and fixed removably to the supporting structure for replacement, together with the respective drums, when making a brand change.

14 Claims, 3 Drawing Sheets

MANUFACTURING MACHINE FOR PRODUCING TOBACCO INDUSTRY ARTICLES

TECHNICAL FIELD

The present invention relates to a manufacturing machine for producing tobacco industry articles.

The present invention may be used to advantage in a manufacturing machine for producing combination cigarette filters, to which the following description refers purely by way of example.

BACKGROUND ART

A manufacturing machine for producing combination cigarette filters comprises a group-forming unit that forms groups of filter portions, each comprising at least two different filter portions aligned axially and contacting at the ends; a wrapping unit which receives a succession of groups of filter portions from the group-forming unit, wraps a strip of wrapping material about the succession of groups of filter portions to form a continuous filter rod, and cuts combination filters from the continuous filter rod by cyclically cutting the filter rod transversely; and a transfer unit which transfers the groups of filter portions from the group-forming unit, in which the groups of filter portions travel transversely (i.e. perpendicular to their central axes), to the wrapping unit, in which the groups of filter portions travel axially (i.e. parallel to their central axes).

The group-forming unit comprises a frame that rests on the floor and supports a number of structurally identical feed stations, each for supplying respective filter portions to form the groups of filter portions. Each feed station comprises a top hopper housing a mass of respective filter portions; a number of cascaded drums, the first of which withdraws the filter portions successively from the bottom of the hopper; and at least one insertion drum, in which the filter portions received from the end drum of said number are inserted into respective groups of filter portions.

Examples of group-forming units of manufacturing machines for producing combination filters are to be found in EP0383970A1, EP1016350A2, U.S. Pat. No. 3,357,320A1 and U.S. Pat. No. 4,237,778A1.

To meet changing market demand, a modern manufacturing machine must be able to produce a range of combination cigarette filters, which means brand changes are relatively frequent to change the machine over to the manufacture of a different type of combination filter. Very often, the new type of combination cigarette filter calls for using filter portions of a different size/composition, so the brand change calls for changing some or all of the operating parts of one or more feed stations. Changing some or all of the operating parts of a feed station is a complicated, time-consuming job, both to dismantle the existing operating parts, and above all to assemble the new parts. Dismantling the existing operating parts may be time-consuming and complicated by access to the feed station being hindered by the adjacent feed stations; whereas assembling the new parts is always time-consuming and complicated, on account of the necessity, once the new operating parts are connected mechanically (which in itself is done fairly quickly), to calibrate/adjust the new parts so they interact properly.

DISCLOSURE OF THE INVENTION

It is an object of the present invention to provide a manufacturing machine for producing tobacco industry articles, designed to eliminate the above drawbacks and which is also cheap and easy to produce.

According to the present invention, there is provided a manufacturing machine for producing tobacco industry articles, as claimed in the accompanying Claims.

BRIEF DESCRIPTION OF THE DRAWINGS

A non-limiting embodiment of the present invention will be described by way of example with reference to the accompanying drawings, in which.

PREFERRED EMBODIMENTS OF THE INVENTION

Figure 1:
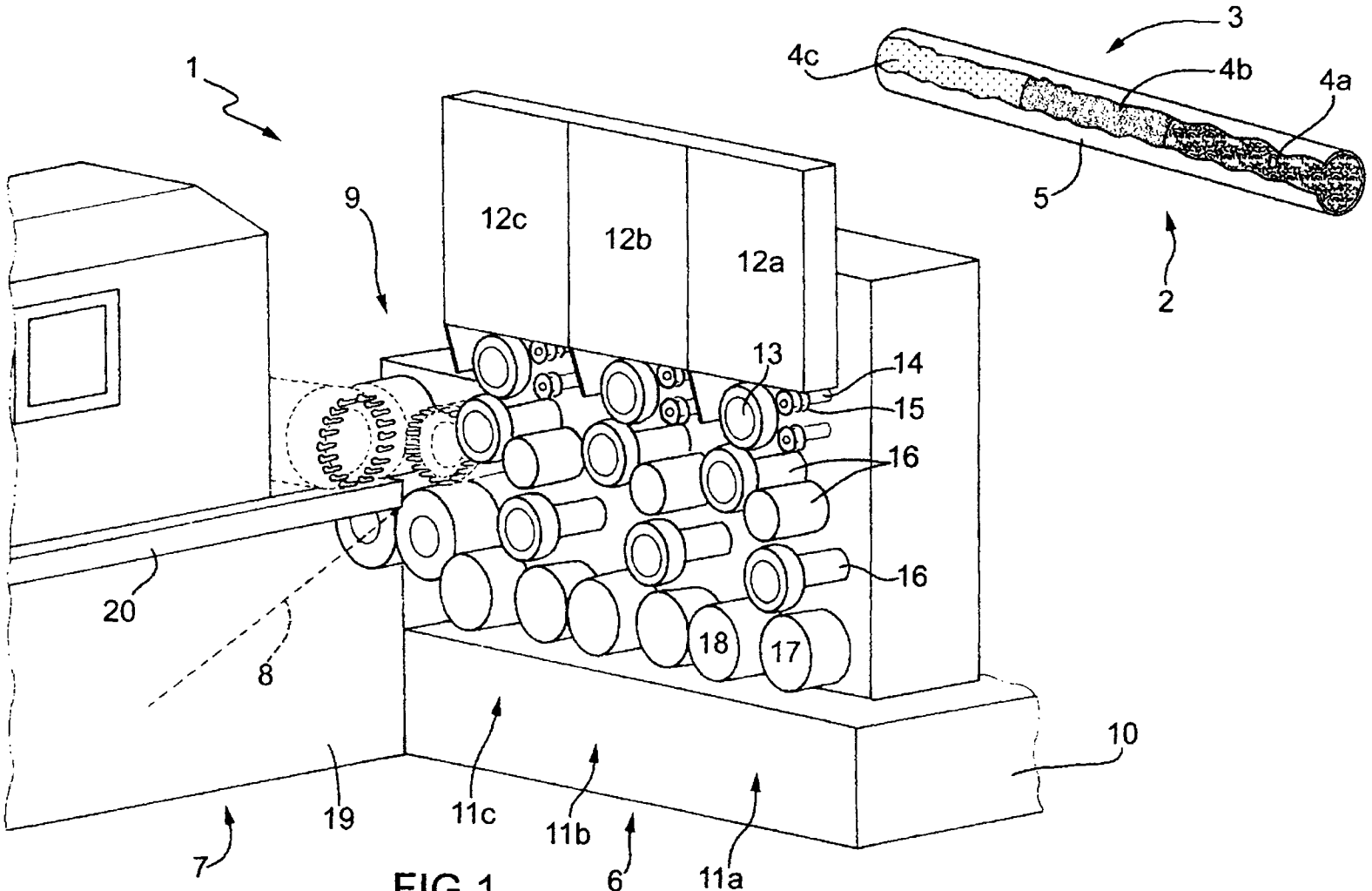
FIG. 1 shows a schematic view in perspective, with parts removed for clarity, of a manufacturing machine for producing tobacco industry articles, in accordance with the present invention.

Number 1 in FIG. 1 indicates as a whole a manufacturing machine for producing combination cigarette filters 2, each of which comprises a group 3 of filter portions 4 wrapped in a sheet 5 of wrapping material folded and glued into a tube.

Manufacturing machine 1 comprises a group-forming unit 6 for forming groups 3 of filter portions 4, each comprising three different filter portions 4 aligned axially and contacting at the ends. Manufacturing machine 1 also comprises a wrapping unit 7, which receives a succession of groups 3 of filter portions 4 from group-forming unit 6, wraps a strip 8 of wrapping material about the succession of groups 3 of filter portions 4 to form a continuous filter rod (not shown), and cuts individual combination filters 2 from the continuous filter rod by cyclically cutting the filter rod transversely. Finally, manufacturing machine 1 comprises a transfer unit 9, which transfers groups 3 of filter portions 4 from group-forming unit 6, in which groups 3 of filter portions 4 travel transversely (i.e. perpendicular to their central axes), to wrapping unit 7, in which groups 3 of filter portions 4 travel axially (i.e. parallel to their central axes).

Group-forming unit 6 comprises a frame 10 that rests on the floor and supports three structurally identical feed stations 11, each for supplying respective filter portions 4 to form groups 3 of filter portions 4. Each feed station 11 comprises a top hopper 12 housing a mass of respective filter portions 4 of a length that is a multiple of the final length; a withdraw drum 13 that withdraws filter portions 4 successively from the bottom of hopper 12, and cooperates with two cutting drums 14 fitted with respective circular blades 15 to cut filter portions 4 transversely to the desired length; a set of three aligning drums 16, which receive and correctly align the cut filter portions 4; an insertion drum 17, which receives groups 3 of filter portions 4 from a preceding feed station 11 or, in the case of the first feed station 11, forms groups 3 of filter portions 4, and inserts the filter portions 4 received from an end aligning drum 16 into respective groups 3 of filter portions 4; and, finally, an output drum 18, which receives groups 3 of filter portions 4 from insertion drum 17, and transfers groups 3 of filter portions 4 to the next feed station 11 or, in the case of the last feed station 11, to transfer unit 9.

Wrapping unit 7 is a two-line type, and comprises a frame 19 resting on the floor and supporting a horizontal forming beam 20 having two parallel grooves, inside each of which a respective strip 8 of wrapping material is wrapped about a continuous succession of groups 3 of filter portions 4 contacting end to end and travelling in a direction parallel to their longitudinal axes, to form a continuous filter rod (not shown).

Transfer unit 9 is of the type described in Patent Application EP1787534A1, which is included herein by way of reference, and to which the reader is referred for a description of the structure and operation of transfer unit 9.

Figure 2:
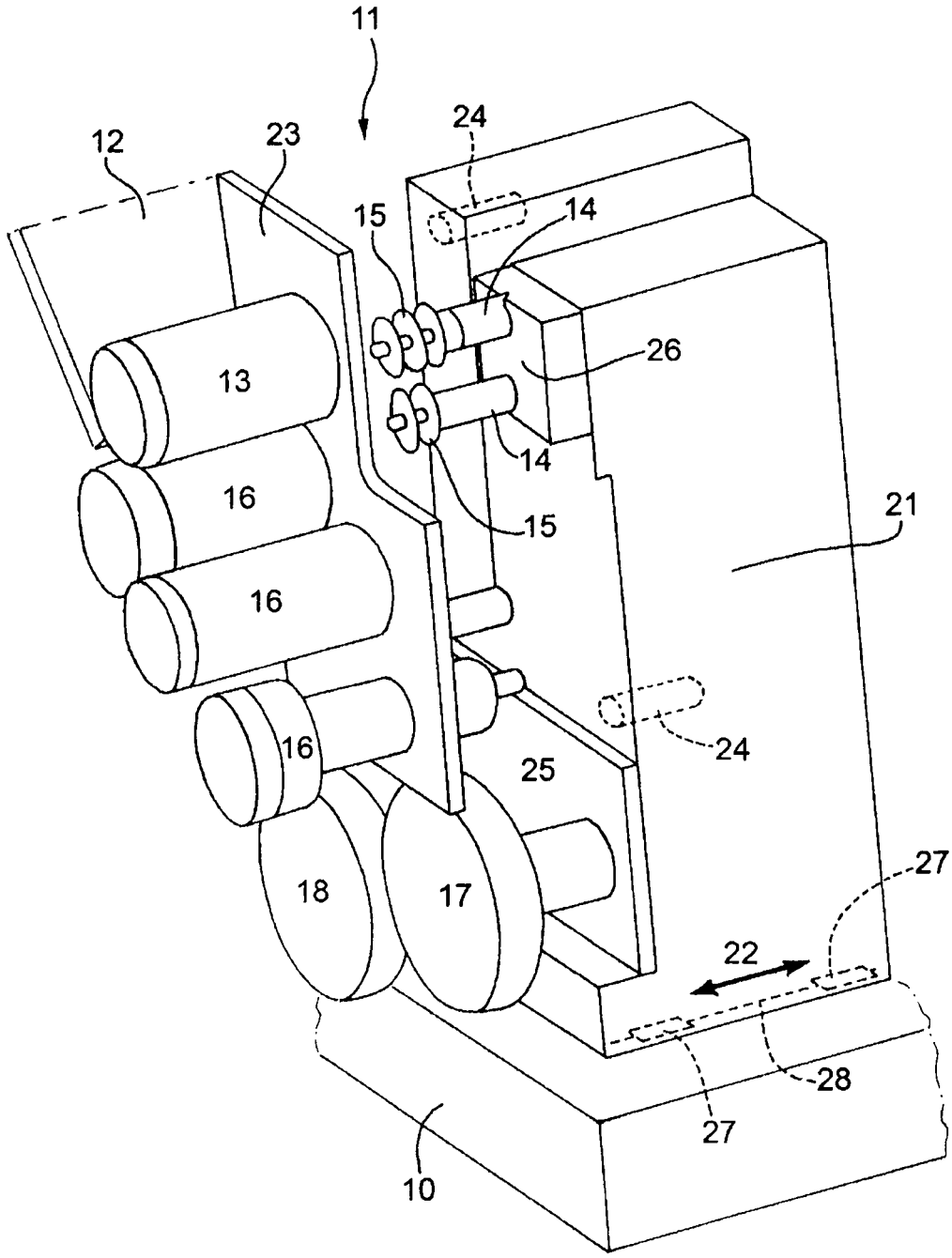
FIG. 2 shows a partly exploded view in perspective of a feed station of the FIG. 1 manufacturing machine.

As shown in FIG. 2, each feed station 11 comprises a parallelepiped-shaped box supporting structure 21 fitted to frame 10 of group-forming unit 6 to slide in a horizontal slide direction 22 parallel to the axes of rotation of drums 13, 14, 16, 17, 18 of feed station 11. Each supporting structure 21 houses all the operating parts of feed station 11, i.e. hopper 12, withdraw drum 13, cutting drums 14, aligning drums 16, insertion drum 17, and output drum 18.

In a preferred embodiment, each feed station 11 comprises a vertical front panel 23 fixed to supporting structure 21 by a number of fast-fit fastening devices 24, and supporting some of the operating parts of feed station 11. More specifically, as shown in FIG. 2, each front panel 23 supports a bottom portion of hopper 12 having an outlet; withdraw drum 13; and aligning drums 16. Each feed station 11 also comprises a vertical front panel 25 fixed to supporting structure 21, below front panel 23, by a number of screws and supporting insertion drum 17 and output drum 18. Finally, each feed station 11 comprises a vertical front panel 26 fixed to supporting structure 21, alongside front panel 23, by a number of screws and supporting cutting drums 14.

Front panels 23 are designed to be interchangeable when making a brand change. In other words, when making a brand change, each front panel 23 (together with respective drums 13 and 16) can be removed quickly from respective supporting structure 21 and replaced with another front panel 23 for processing a different type of filter portion 4.

Moreover, when making a brand change, each supporting structure 21 can be slid in slide direction 22 with respect to frame 10 to adjust the position of drums 17 and 18 of respective feed station 11 as a function of the size of filter portions 4 for processing. In other words, as opposed to moving drums 17 and 18 of feed station 11 axially with respect to supporting structure 21, the whole of supporting structure 21 is preferably slid in slide direction 22 with respect to frame 10. In a preferred embodiment, each supporting structure 21 rests on a number of carriages 27 that run along two (or more) runners 28 fitted to a top wall of frame 10 and parallel to slide direction 22. It is important to note that supporting structures 21 can be slid in slide direction 22 either manually by an operator, or by respective electric or pneumatic actuators.

When making a brand change at feed station 11, the current front panel 23 (supporting corresponding drums 13 and 16) can be replaced with a similar new front panel 23 (supporting corresponding drums 13 and 16), so no calibration/adjustment is required of the new drums 13 and 16, which, being fitted all together on the same front panel 23, have already been calibrated/adjusted to interact properly. When changing the front panel 23 (supporting corresponding drums 13 and 16) of feed station 11, it may be necessary to adjust the axial position of circular blades 15 along respective cutting drums 14. Since each circular blade 15 has only one degree of freedom (its axial position along respective cutting drum 14), this operation can be performed quickly and easily, and predetermined positions can be marked in each cutting drum 14 to set circular blades 15 to the desired axial positions. Finally, when making a brand change at feed station 11, supporting structure 21 can be moved in slide direction 22 with respect to frame 10 to adjust the position of drums 17 and 18 of respective feed station 11 as a function of the size of filter portions 4 for processing. The position of drums 17 and 18 with respect to supporting structure 21 thus remains unchanged, so there is no change in the interaction of the two drums 17 and 18 or in the interaction of insertion drum 17 and the final aligning drum 16.

Figure 3:
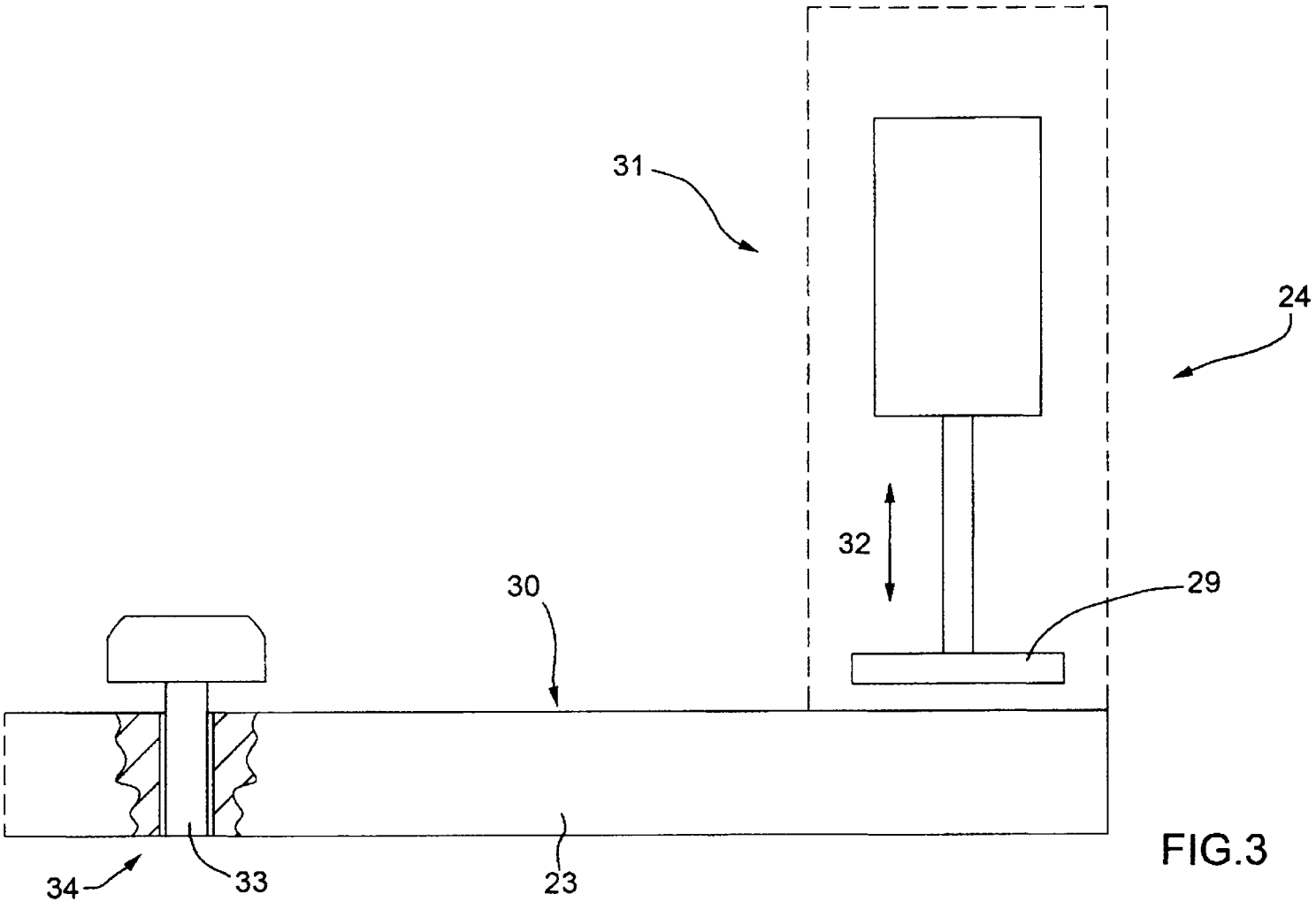
FIG. 3 shows a schematic plan view, with parts removed for clarity, of a fastening device of the FIG. 2 feed station.

As shown in FIG. 3, each fastening device 24 of each feed station 11 comprises a permanent magnet 29 that adheres magnetically to an inner wall 30 of respective front panel 23; and a linear actuator 31 (typically a pneumatic cylinder) fixed to supporting structure 21 and supporting permanent magnet 29. Linear actuator 31 moves permanent magnet 29, in a shift direction 32 perpendicular to inner wall 30 of respective front panel 23, between a lock position (not shown), in which permanent magnet 29 adheres magnetically to inner wall 30 to draw front panel 23 to supporting structure 21, and a release position (shown in FIG. 3), in which permanent magnet 29 is detached from inner wall 30 and does not draw front panel 23 to supporting structure 21.

In a preferred embodiment, each supporting structure 21 also comprises mechanical locators 33 (only one shown in FIG. 3) for ensuring correct relative positioning of panel 23 and supporting structure 21. Mechanical locators 33 typically comprise pins that project from supporting structure 21 and engage corresponding cylindrical holes 34 formed through front panel 23. An end portion of each mechanical locator 33 is preferably truncated-cone-shaped for self-centering performance. To assemble a new front panel 23, this is first fitted to mechanical locators 33 by inserting mechanical locators 33 inside holes 34 in front panel 23, which is thus positioned correctly with respect to supporting structure 21; and respective fastening devices 24 are then activated to move permanent magnets 29 into the lock position. It is important to note that mechanical locators 33 also serve to prevent slide between front panel 23 and respective supporting structure 21 in directions parallel to front panel 23.

Brand changes in group-forming unit 6 of manufacturing machine 1 described above can be made easily and, above all, quickly, by involving no replacement of individual drums 13-18 at feed stations 11. As stated, changing a drum 13-18 at a feed station 11 is a complicated, time-consuming job, mainly on account of the necessity, once the new drum 13-18 is connected mechanically (which in itself is done fairly quickly), to calibrate/adjust the new drum 13-18 so it interacts properly with the other drums 13-18.

Moreover, the design of fastening devices 24 makes front panels 23 fast and easy to change.

The invention claimed is:

1. A manufacturing machine for producing tobacco industry articles, and comprising:

at least one station including a number of drums cooperating with one another to convey and process portions of smoking material, the portions of smoking material including filter portions; and a supporting structure fitted to a frame;

wherein the station includes a vertical first front panel which directly supports at least some of the drums at the station and is fixed removably to the supporting structure to be replaceable together with the respective drums and without removing the respective drums from the first front panel, so that when making a brand change, the first front panel and the respective drums that remain always fixed to the first front panel are removed together from the supporting structure, and a new first front panel and new respective drums that are already provided with the new first front panel are attached together to the supporting structure.

2. A manufacturing machine as claimed in claim 1, wherein the station is a feed station of a group-forming unit forming groups of the filter portions, each including at least two different filter portions aligned axially and contacting at the ends;

the feed station including:

a top hopper housing a mass of respective filter portions;

a group of drums which withdraw the filter portions successively from the bottom of the hopper, and are fitted to the first front panel; and an insertion drum, in which the filter portions received from the group of drums are inserted inside respective groups of filter portions.

3. A manufacturing machine as claimed in claim 2, wherein the first front panel supports a bottom portion of the hopper having an outlet.

4. A manufacturing machine as claimed in claim 2, wherein the feed station includes a vertical second front panel fixed to the supporting structure, below the first front panel, and supporting the insertion drum.

5. A manufacturing machine as claimed in claim 4, wherein the feed station includes an output drum which receives the groups of filter portions from the insertion drum and is fitted to the second front panel.

6. A manufacturing machine as claimed in claim 2, wherein the group of drums includes:

a withdraw drum which withdraws the filter portions successively from the bottom of the hopper, and cooperates with at least one cutting drum to cut the filter portions transversely; and a number of aligning drums which receive the cut filter portions and align the filter portions correctly.

7. A manufacturing machine as claimed in claim 6, wherein the feed station includes a vertical third front panel located alongside the first front panel and supporting the cutting drum.

8. A manufacturing machine as claimed in claim 2, wherein the supporting structure is fitted to the frame to slide in a horizontal slide direction, parallel to the axes of rotation of the drums at the feed station, to adjust the position of the drums as a function of the size of the filter portions for processing.

9. A manufacturing machine as claimed in claim 1, wherein the vertical first front panel is fixed removably to the supporting structure by a number of fast-fit devices, each including:

a permanent magnet which adheres magnetically to an inner wall of the first front panel; and a linear actuator fixed to the supporting structure and supporting the permanent magnet to move the permanent magnet, in a shift direction perpendicular to the inner wall of the first front panel, between a lock position, in which the permanent magnet adheres magnetically to the inner wall to draw the first front panel to the supporting structure, and a release position, in which the permanent magnet is detached from the inner wall and does not draw the first front panel to the supporting structure.

10. A manufacturing machine as claimed in claim 9, wherein the supporting structure includes mechanical locators that position the first front panel correctly with respect to the supporting structure.

11. A manufacturing machine as claimed in claim 10, wherein the mechanical locators are defined by pins projecting from the supporting structure, and which engage corresponding cylindrical holes formed through the first front panel.

12. A manufacturing machine for producing tobacco industry articles, and comprising:

at least one station including a number of drums cooperating with one another to convey and process portions of smoking material, the portions of smoking material including filter portions; and a supporting structure fitted to a frame;

wherein the station includes a vertical front panel supporting at least some of the drums at the station and fixed removably to the supporting structure for replacement, together with the respective drums, when making a brand change;

wherein the station is a feed station of a group-forming unit forming groups of the filter portions, each including at least two different filter portions aligned axially and contacting at the ends;

the feed station including:

a top hopper housing a mass of respective filter portions;

a group of drums which withdraw the filter portions successively from the bottom of the hopper, and are fitted to the front panel; and an insertion drum, in which the filter portions received from the group of drums are inserted inside respective groups of filter portions; and wherein the supporting structure is fitted to the frame to slide in a horizontal slide direction, parallel to the axes of rotation of the drums at the feed station, to adjust the position of the drums as a function of the size of the filter portions for processing.

13. A manufacturing machine for producing tobacco industry articles, and comprising:

at least one station including a number of drums cooperating with one another to convey and process portions of smoking material, the portions of smoking material including filter portions; and a supporting structure fitted to a frame and supporting the drums at the station;

wherein the station is a feed station of a group-forming unit for forming groups of filter portions, each including at least two different filter portions aligned axially and contacting at the ends;

the feed station including:

a top hopper housing a mass of respective filter portions;

a group of drums which withdraw the filter portions successively from the bottom of the hopper; and an insertion drum, in which the filter portions received from the group of drums are inserted inside respective groups of filter portions; and wherein the supporting structure is fitted to the frame to slide in a horizontal slide direction, parallel to the axes of rotation of the drums at the feed station, to adjust the position of the drums as a function of the size of the filter portions for processing.

14. A method of making a brand change in a manufacturing machine for producing tobacco industry articles; the manufacturing machine comprising:

at least one station including a number of drums cooperating with one another to convey and process portions of smoking material, the portions of smoking material including filter portions; and a supporting structure fitted to a frame; and wherein the station includes a vertical front panel which directly supports at least some of the drums at the station and is fixed removably to the supporting structure to be replaceable together with the respective drums and without removing the respective drums from the front panel; and when making a brand change, the method comprising the steps of:

removing together the front panel and the respective drums that remains always fixed to the front panel from the supporting structure; and attaching together a new front panel and new respective drums that are already provided with the new front panel to the supporting structure.

* * * * *